United States Patent [19]

Kawakami et al.

[11] 4,098,071

[45] Jul. 4, 1978

[54] TIME SIGNAL CLOCK

[75] Inventors: Hakuhei Kawakami, Kadoma; Kenzo Hatada, Katano; Takeshi Ishihara, Neyagawa, all of Japan

[73] Assignee: Matsushita Electric Industrial Co., Ltd., Kadoma, Japan

[21] Appl. No.: 729,608

[22] Filed: Oct. 4, 1976

[30] Foreign Application Priority Data

| | | | |
|---|---|---|---|
| Oct. 9, 1975 | [JP] | Japan | 50-122679 |
| Oct. 9, 1975 | [JP] | Japan | 50-122680 |
| Oct. 9, 1975 | [JP] | Japan | 50-122681 |
| Oct. 9, 1975 | [JP] | Japan | 50-122682 |

[51] Int. Cl.[2] ..... G04C 17/02; G04C 21/14; G04C 21/30

[52] U.S. Cl. ..... 58/39; 58/13; 58/19 A; 58/19 B; 58/19 C; 58/21.12; 58/152 A; 58/152 B

[58] Field of Search ..... 58/19 R, 19 A, 19 B, 58/19 C, 21.12, 38 R, 38 A, 39, 152 A, 152 B, 13

[56] References Cited

U.S. PATENT DOCUMENTS

| | | | |
|---|---|---|---|
| 890,134 | 6/1908 | Gaillard | 58/19 A |
| 3,407,402 | 10/1968 | Morrison et al. | 58/19 R X |
| 3,631,451 | 12/1971 | Schmitt | 58/19 R X |
| 3,681,916 | 8/1972 | Itoyama et al. | 58/39 |
| 3,728,855 | 4/1973 | Preiser | 58/38 R |
| 3,747,331 | 7/1973 | Nyberg | 58/19 R X |
| 3,759,029 | 9/1973 | Komaki | 58/38 R |
| 4,055,843 | 10/1977 | Whitaker | 58/13 X |

*Primary Examiner*—Stanley J. Witkowski
*Attorney, Agent, or Firm*—Wenderoth, Lind & Ponack

[57] ABSTRACT

A time signal clock is equipped with a time indicating graduation, a dividing circuit for dividing a standard oscillation frequency, a drive for time indication provided with an electronic circuit for driving a pointer over the time indicating graduation by the signal from the dividing circuit, a time detecting device provided with a time detecting circuit for detecting a set time, a time signal electronic circuit receiving as its input signal the output signal from the time detecting device and a time signal device operated by the signal from the time signal electronic circuit.

11 Claims, 17 Drawing Figures

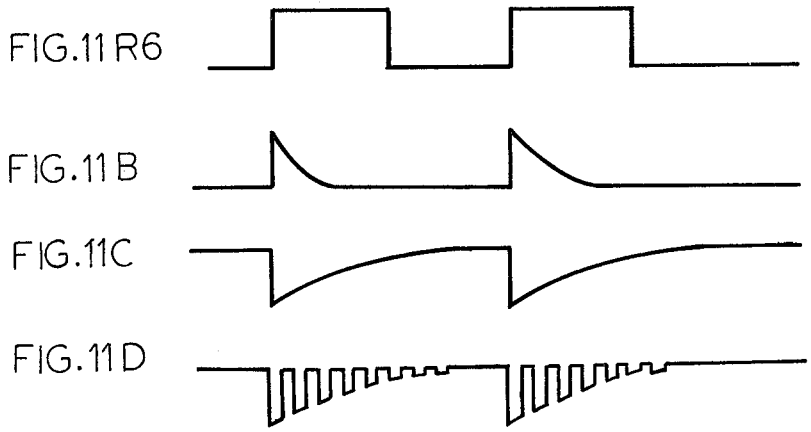
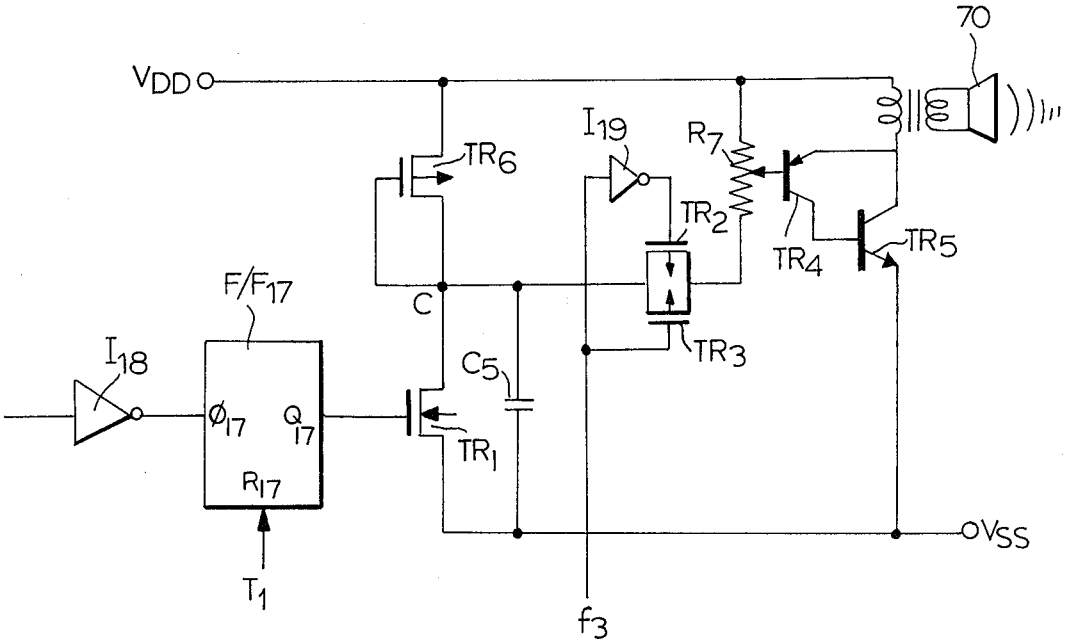
FIG.12

TIME SIGNAL CLOCK

The present invention relates to a time signal clock which indicates the time by moving a pointer by a motor drive, under the control of a quartz oscillator or commercial power frequency as the standard frequency, while giving time signals by sound.

The construction of a conventional quartz oscillator controlled clock is shown schematically in to FIG. 1. In the clock of FIG. 1, the standard frequency is established by the quartz vibrator 1 which serves as the standard frequency oscillation source; the aforementioned standard frequency is divided to obtain the desired frequency by the dividing circuit 2; and a signal of this desired frequency is transmitted to the driving means 3 including a step motor, etc., so that the time is indicated on the time indicating means 5 such as a graduated face by motor driven pointer means 4 having a long hand, a short hand, a second hand, etc. The power is supplied normally at a voltage of 1.5 V ~ 3.0 V to the dividing circuit or the drive 3. While in the clock of FIG. 1, the standard frequency is obtained from the quartz vibrator, the commercial power frequency can also be used as the standard frequency.

With conventional clocks of this type, it is possible to provide visual perception of time by making the analogue indication of time the angle of the pointer, but they can not be equipped with a time signal giving means such as will produce a striking sound like such means provided in mechanical clocks.

The making of part or all of the chronometric device as shown in FIG. 1 electronic has brought about remarkable improvements in the accuracy of clocks and improved the simplicity of the chronometric devices themselves, but it has not been possible to provide means for detecting the time to be signaled. There has thus been provided clocks with high accuracy, but which are incapable of giving a time signal.

However, not only the visual but also the auditory senses as a means of perceiving time are very important. For example, it is possible to readily perceive a time indicating sound signal while engaging in work without glancing at the clock from time to time. Further, the time as signaled by sound may be perceived by a person outside the angle from which the face of the clock is visible. The conventional electronic clocks with indicating hands are deficient in that they have no time indicating signal giving means as described above.

This invention provides a novel time signal clock equipped with time indicating signal giving means, such as a sound or light signal, which also indicates the time by moving a pointer means, such as hands, by a motor drive under the control of a quartz vibrator or commercial power frequency providing the standard frequency.

A more detailed description of the invention is given in the following specification with reference to the accompanying drawings in which.

Figure 14:
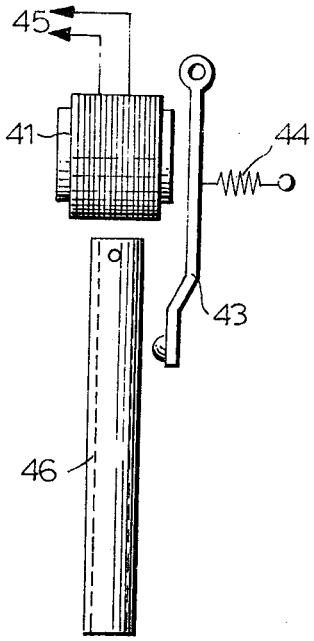
Figure 9:
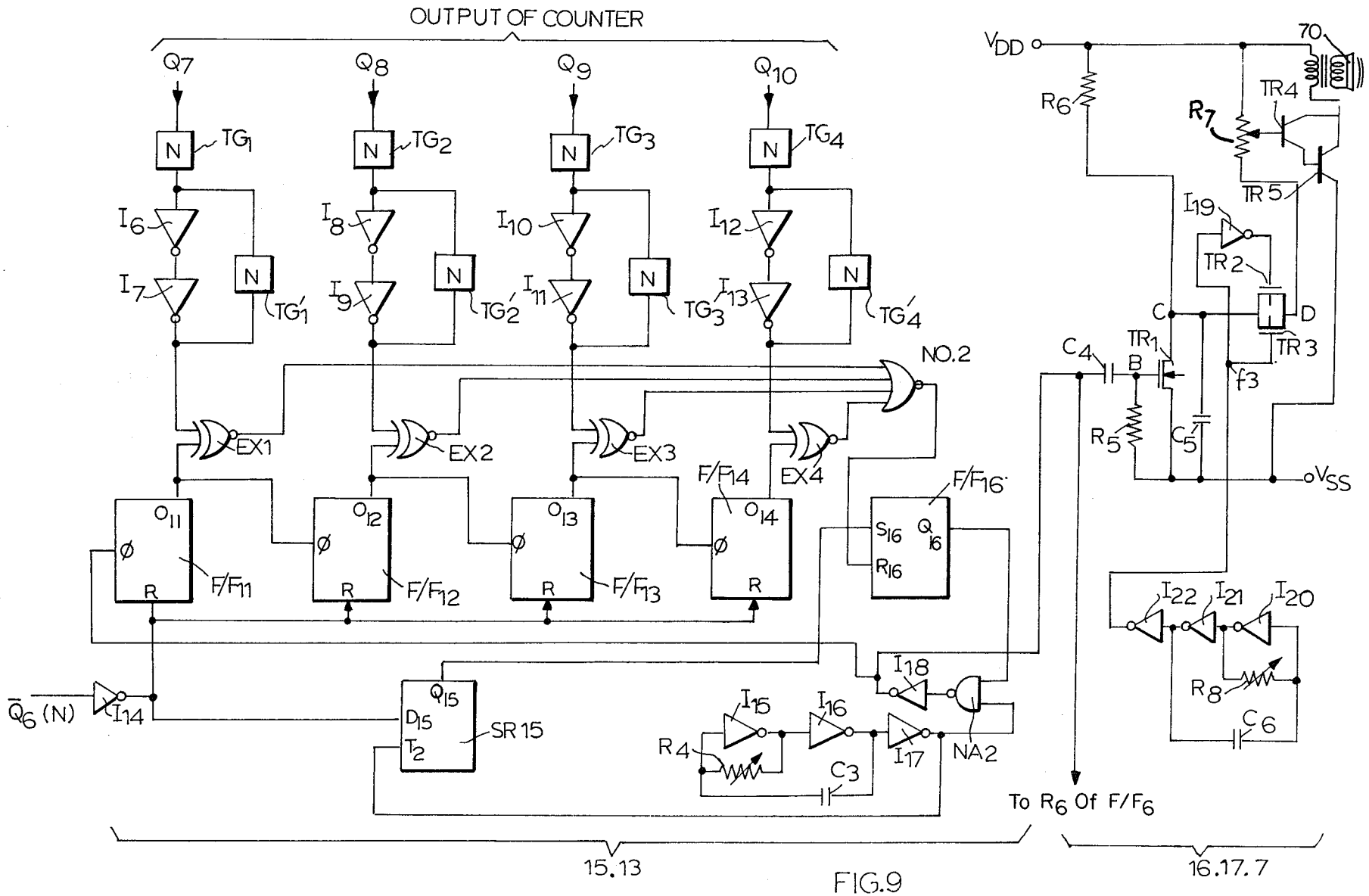
Figure 10:
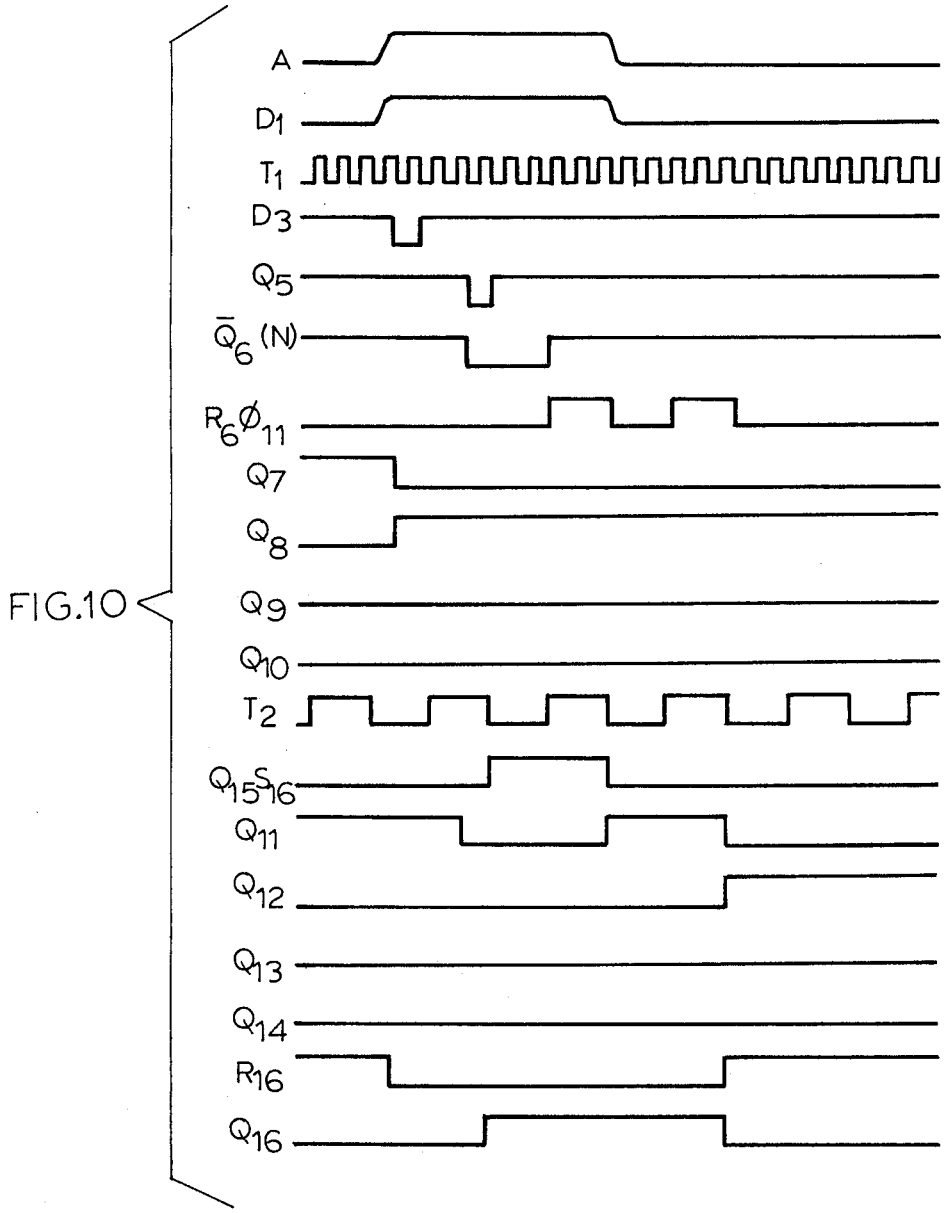
Figure 13:
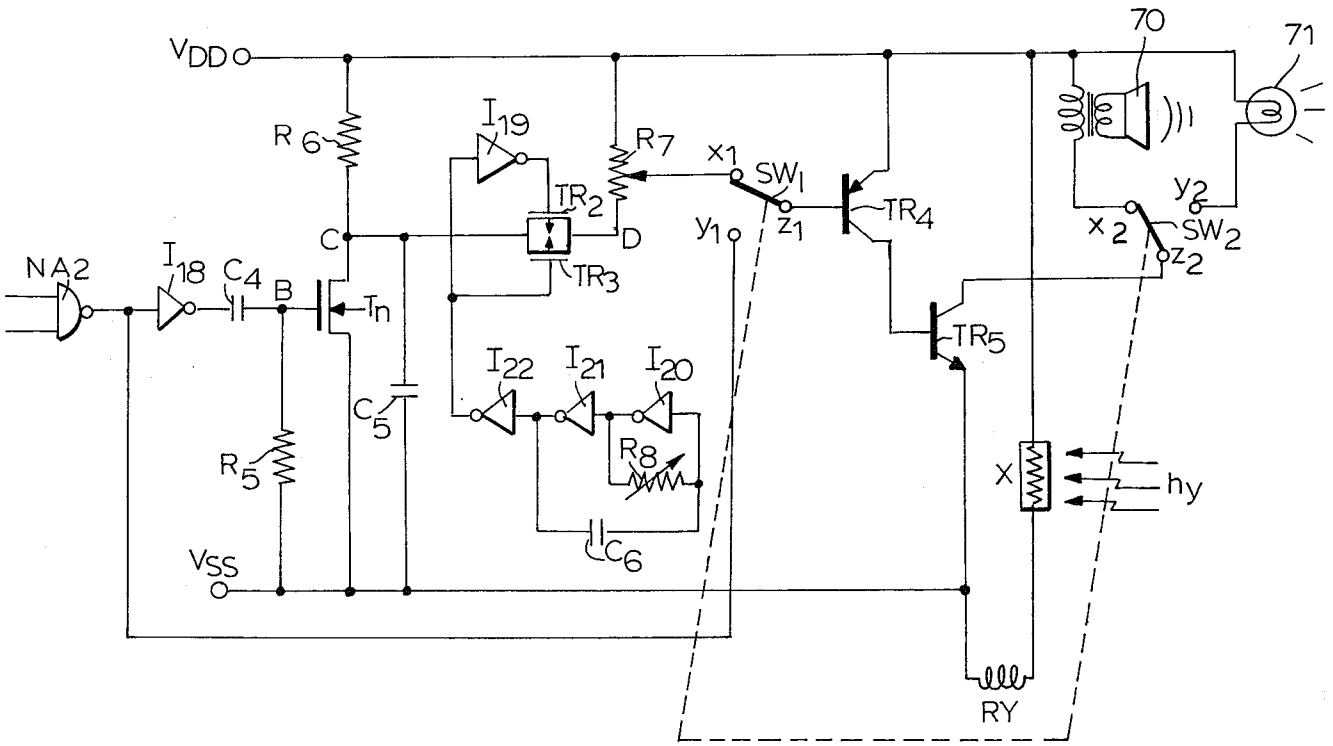

FIGS. 10, 11R6, 11B, 11C and 11D are wave form diagrams of the signals at various points in the time indicating signal giving electronic circuits;

FIGS. 12 and 13 are circuit diagrams of modified forms of the time indicating signal giving electronic circuit shown in FIG. 9; and FIG. 14 is a view showing a bell mounted on the time signal clock of the present invention.

Figure 1:
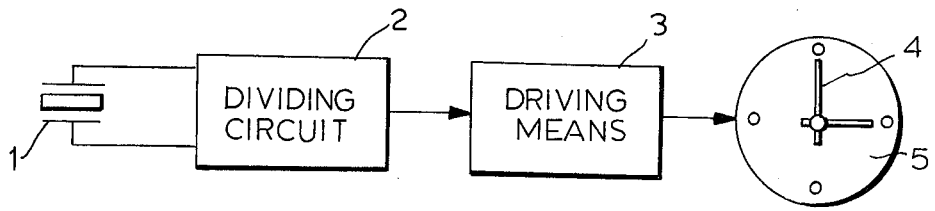
FIG.1 PRIOR ART
FIG. 1 is a schematic block diagram of the construction of a conventional quartz clock.
Figure 2:
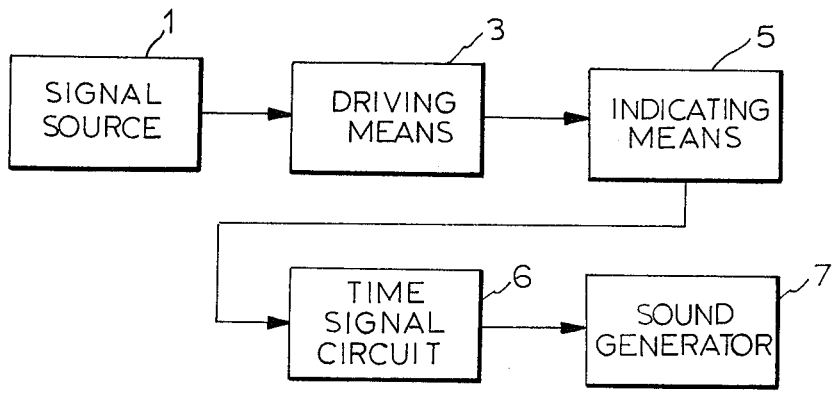
FIG. 2 is a schematic block diagram of the construction of a time signal clock according to the present invention.
Figure 3:
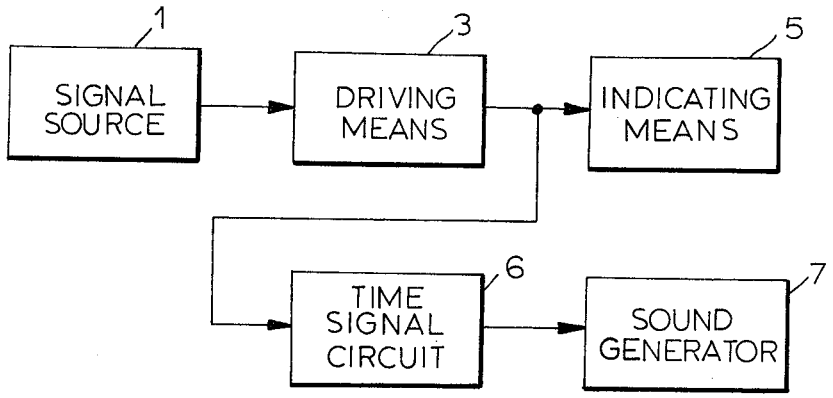
FIG. 3 is a schematic block diagram of a modified form of the clock of FIG. 2.

Embodiments of the time signal clock according to this invention are shown schematically in FIGS. 2 and 3. The time signal clock of this invention is composed, as shown in FIG. 2, of a mechanism capable of giving an indication, such as a visual indication, of time and having of the standard signal source 1, driving means 3 including a dividing circuit such as the circuit 2 in FIG. 1, and an indicating means 5, and a mechanism capable of giving an auditory indication of time and having a time signal circuit 6 operated by an output from the indicating means 5, and the output of which is, in turn, converted into sound by means of a sound generator 7 consisting of a speaker, or the like. While in the embodiment of FIG. 2 the source for the input to the time signal circuit 6 is the indicating means 5, in the case of analogue electronic clocks, time pulses paralleling those supplied to the indicating means 5 can be taken out of the driving means 3 as an output and be used as the input to the time signal circuit 6 to operate the time indicating signal giving mechanism.

Figure 4:
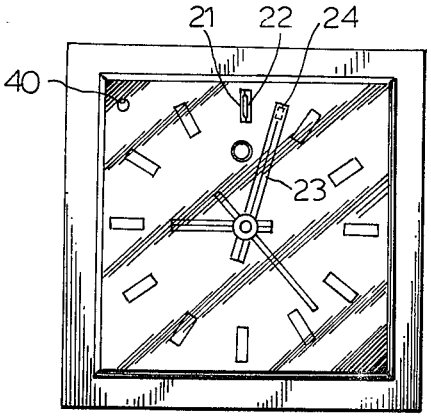
FIG. 4 is a front view of a time signal clock embodying the present invention.
Figure 5:
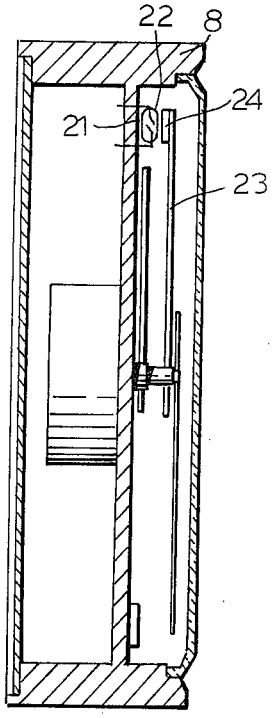
FIG. 5 is a sectional side elevation view of the time signal clock shown in FIG. 4.

The main components of the time indicating signal giving mechanism include the time detecting means for producing an output from the indicating means 5, a time signal circuit 6 and time indicating signal giving means 7. One example of the time detecting means is shown in FIGS. 4 and 5. This example of the time detecting means of this invention is composed of a permanent magnet and a magnetically sensitive switch, for example, a reed switch. The most essential key to finding a way of detecting the time for which a signal is to be given is that at all such times, the long hand is superposed on a graduation on the indicating means. For example, as shown in FIGS. 4 and 5, the reed switch 22 which is operated by magnetic force is located at the position of the graduation 21 for 12 o'clock provided on the clock face mounted in housing 8, and a permanent magnet 24 is fixed to the tip of the long hand 23 at a position such that it moves across the aforementioned reed switch at a specified distance therefrom. Accordingly, when the long hand 23 comes to the graduation for 12 o'clock, that is, at the set time, the aforementioned reed switch is actuated, i.e. is either opened or closed, by the magnetic force of the permanent magnet 24 mounted on the long hand 23. In that way, a signal is transmitted from the reed switch to the time signal circuit each hour. This example of the detecting means of this invention can be adapted for producing a signal for any desired time merely by providing the detecting means at a position on the indicating means corresponding to the desired time.

Figure 6:
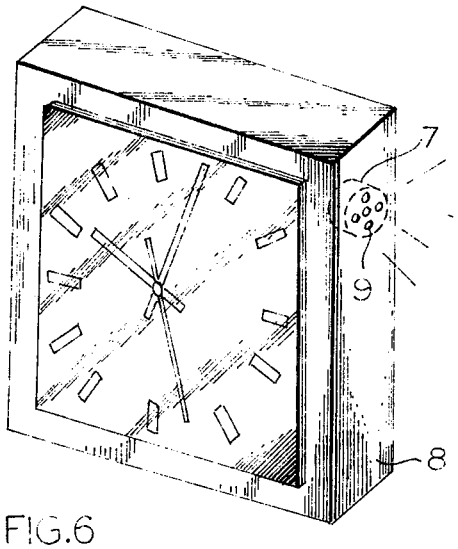
FIG. 6 is a perspective view showing a speaker mounted on the time signal clock of the present invention.

FIG. 6 shows one way of mounting a sound generator 7 which is in the form of a speaker 9 in the housing 8 of the clock. The speaker 9 for giving the time indicating signal is shown as being mounted on the side of the housing. While with the construction of FIG. 6, the sound of the time indicating signal will be heard from the side of the clock, the speaker may be installed at any desired position, such as the top, bottom or front of the housing 8.

The construction of the time signal circuit will be described with reference to FIG. 7. This circuit is composed of the time detecting circuit 10 attached to part of the indicating means 5, a switch circuit 11 connected to the time detecting circuit 10 for shaping the wave form of the output of the time detecting circuit, a counting circuit 12 connected to the switch circuit and which records the time given by the indicating means 5, a comparison circuit 15 connected to the counting circuit, a series connected delay circuit 14 and pulse series producing circuit 13 connected to the switch circuit 11 in parallel with the counting circuit 12 and which provides a delay of the inputs to the pulse series producing circuit 13. The comparison circuit 15 is connected to the pulse series producing circuit for comparing the output of the counting circuit 12 with the number of pulses from the pulse series producing circuit 13 which produces a number of pulses corresponding to time indicated by the indicating means 5. A modulation circuit 16 converts the pulses from pulse series producing circuits into audible frequencies, thereby providing a reverberation effect, and an amplifier circuit 17 subjects the output from modulation circuit 16 to DC amplification and the output thereof is connected to the sound generator 7 which turns this output into sound. It is to be noted that if the signal produced by the time detecting circuit 10 is free of noise, the switching circuit 11 may be omitted, but its presence is preferred for prevention of misoperation. Sometimes, depending on the circuit construction of the pulse series producing circuit 13, the delay circuit 14 may be omitted, and the modulator circuit may be omitted and the time signal sound produced directly from the output signal of the circuit 13.

Figure 7:
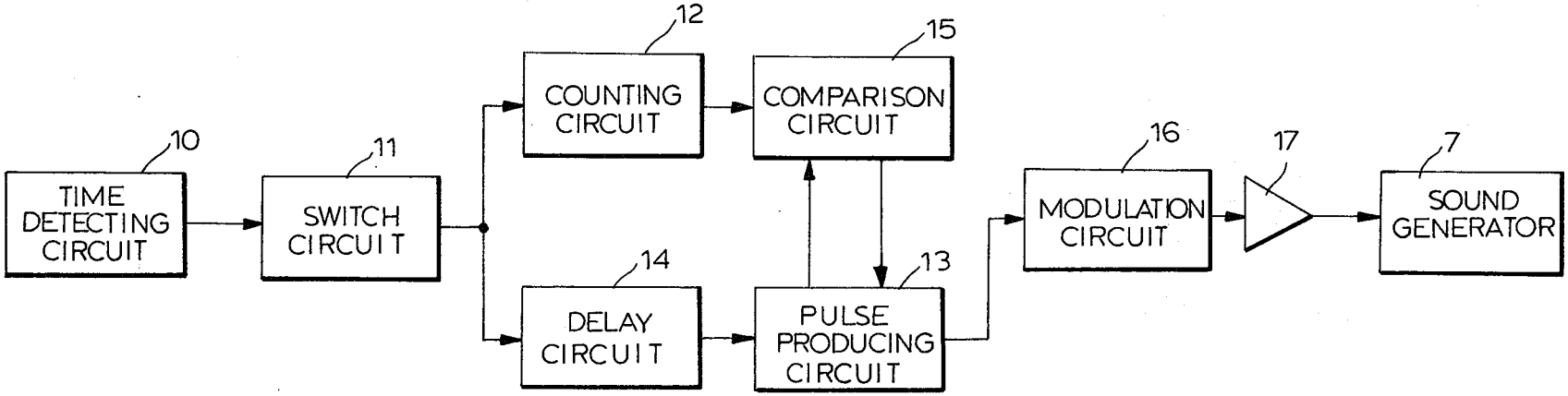
FIG. 7 is a block diagram showing the construction of a time indicating signal giving circuit.
Figure 8:
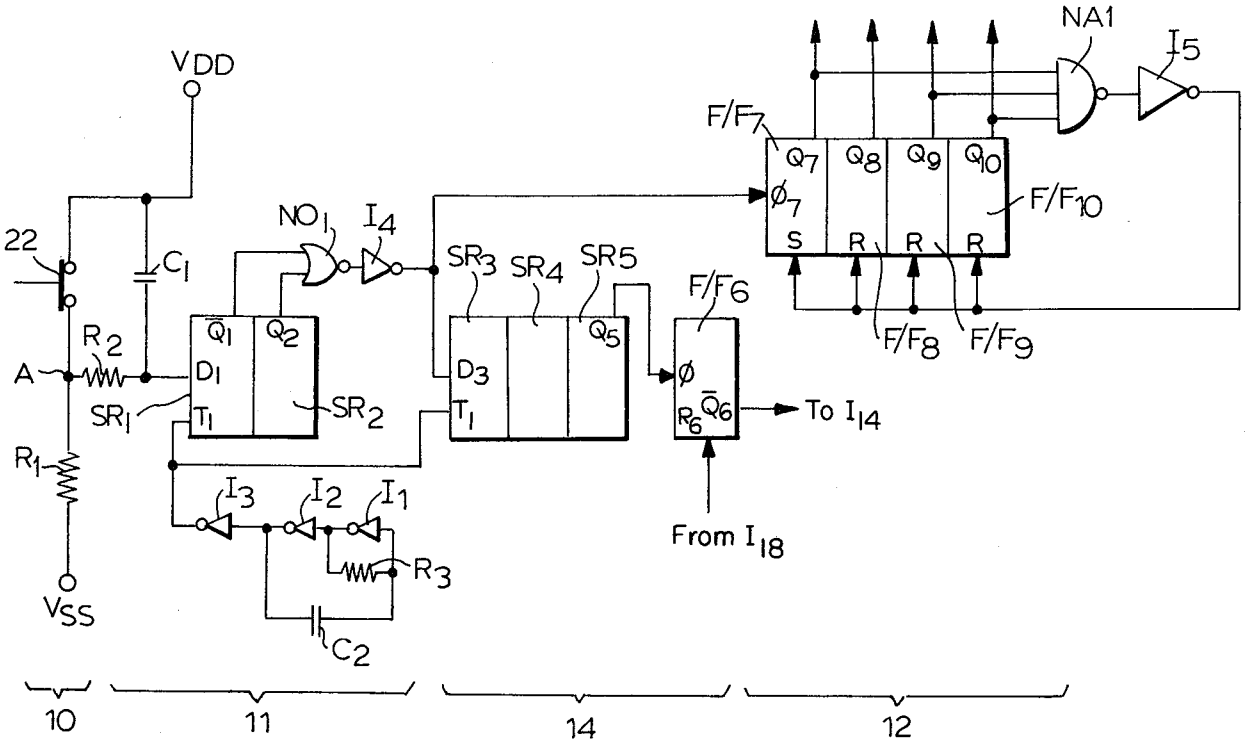
FIGS. 8 and 9 are circuit diagrams of time indicating signal giving electronic circuits employed in the present invention.

In the following, the construction of the time signal circuit shown schematically in FIG. 7 is described further in detail with reference to FIG. 8. At the position on the face plate of the indicating means 5 corresponding to the time to be indicated by the signal, for example, the position 21 for 12 o'clock, the magnetically sensitive switch 22 is installed, and on the side of the long hand 23 toward the clock, the permanent magnet 24 is mounted, as shown in FIG. 4. One end of the magnetically sensitive switch 22 is, as shown in FIG. 8, connected to the high potential (hereinafter designated by $V_{DD}$) side of the power supply, and the other end A shown in FIG. 8 is joined to the low potential (hereinafter designated by $V_{SS}$) side of the supply through the resistance $R_1$, thus providing an output from the time detecting circuit 10 at A. This output is the input to the switch circuit 11 having an integrating circuit composed of the resistance $R_2$ and condenser $C_1$, the output of this integrating circuit being fed as the input $D_1$ to the shift register (hereinafter designated by SR) $SR_1$. The output of $SR_1$ is used as the input to $SR_2$, and the clock signal $T_1$ for $SR_1$ and $SR_2$ is the output from the CR oscillator circuit composed of inverters (hereinafter designated I) $I_1$, $I_2$ and $I_3$ and resistor $R_3$ and condenser $C_2$, which output is that from the inverter $I_3$, the period of the clock signal being $T = (1/C_2R_3)$. The output from the NOR circuit (hereinafter designated by NO) $NO_1$ to which the inverse phase output signal $\overline{Q}_1$ from $SR_1$ and the output signal $Q_2$ from $SR_2$ are supplied as input is fed as the input to the inverter $I_4$, thereby forming a one-shot circuit, and the output from $I_4$ is supplied both as the input $D_3$ to $SR_3$ and with the input $\phi_7$ to the flip-flop (hereinafter designated by F/F) $F/F_7$. The output from $SR_3$ is linked to the input to $SR_4$, and the output from $SR_4$ to the input to $SR_5$. The, the same clock signal $T_1$ given to $SR_1$ and $SR_2$ is supplied to $SR_3$, $SR_4$ and $SR_5$. The output $Q_5$ from $SR_5$ is used as the input to $F/F_6$, and the output of the series of pulses from the pulse producing circuit 13, that is, the output from the inverter $I_{18}$ shown in FIG. 9, is supplied as the reset input $R_6$ to $F/F_6$. The inverse phase signal $\overline{Q}_6$ which is the output from $F/F_6$ is used as the input to the pulse producing circuit, 13, being the input to the inverter $I_{14}$. The outputs of the flip-flops $F/F_7$-$F/F_{10}$ are connected to the CMOS transfer gates (hereinafter designated by TG) $TG_1$, $TG_2$, $TG_3$ and $TG_4$ which become conductive when the signal N enters the gates and with the transfer gates (hereinafter designated by TG') $TG'_1$, $TG'_2$, $TG'_3$ and $TG'_4$ which becomes conductive when the inverse phase signal N as the output from I enters. The output $Q_7$ from $F/F_7$ is used as the input to $F/F_8$; the output $Q_8$ from $F/F_8$ as the input to $F/F_9$, and the output $Q_9$ as the input to $F/F_{10}$. Outputs $Q_7$ and $Q_9$ and the output $Q_{10}$ from $F/F_{10}$ are supplied to the NAND circuit (hereinafter designated by NA) $NA_1$ as the input; the output thereof is used as the input to the inverter $I_5$, and the output of inverter $I_5$ is supplied to $F/F_7$ as its set input and to $F/F_8$, $F/F_9$ and $F/F_{10}$ as their reset inputs. $F/F_7$ is a set type flip-flop, in which when a signal at a $V_{DD}$ level, hereinafter designated as a signal at the "1" level, a signal at a $V_{SS}$ level hereinafter being designated as a signal at the "0" level, is impressed thereon, the output $Q_7$ is set to the "1" level. Other flip-flops $F/F_6$, $F/F_8 \sim F/F_{14}$ are reset type flip-flops in which when a signal at the "1" level is impressed on the reset terminals, the outputs from the F/F's are at the "0" level.

As shown in FIG. 9, the output $Q_7$ from $F/F_7$ is used as the input to $TG_1$, and the output thereof is supplied to the inverter $I_6$ as the input thereto and to $TG'_1$ as the input thereto. The output of $I_6$ is used as the input to the inverter $I_7$, and the output from $I_7$ associated with the output from $TG'_1$ is provided to the Exclusive-OR circuit (hereinafter designated by EX) as its input. In the same way as the output $Q_7$ from $F/F_7$ is used as the input to the latch circuit composed of $TG_1$ and $TG'_1$, and $I_6$ and $I_7$, and the output thereof is supplied to $EX_1$ as the input thereto, the outputs $Q_8$, $Q_9$ and $Q_{10}$ are respectively used as the inputs to the latch circuit composed of $TG_2$ and $TG'_2$, and $I_8$ and $I_9$, to the latch circuit composed of $TG_3$ and $TG'_3$, and $I_{10}$ and $I_{11}$ and to the latch circuit composed of $TG_4$ and $TG'_4$, and $I_{12}$ and $I_{13}$, and their respective outputs are provided to the Exclusive-OR circuits, $EX_2$, $EX_3$ and $EX_4$, as their inputs. The output from the inverter $I_{14}$ is linked to the reset terminals of $F/F_{11} \sim F/_{14}$ and to the input terminal $D_{15}$ of $SR_{15}$. As the input to $F/F_{11}$, the output from the series of pulses producing circuit, i.e., the output from $I_{18}$, is used. Then, the output $Q_{11}$ from $F/F_{11}$ is used as the input to $F/F_{12}$; its output $Q_{12}$ as the input to $F/F_{13}$ and the output $Q_{13}$ as the input to $F/F_{14}$. Outputs $Q_{11}$, $Q_{12}$, $Q_{13}$ and $Q_{14}$ are also provided to the Exclusive-OR circuits, $EX_1$, $EX_2$, $EX_3$ and $EX_4$ as their inputs, and the outputs from $EX_1$, $EX_2$, $EX_3$ and $EX_4$ are all supplied to the NOR circuit $NO_2$ as the input thereto. The output from $NO_2$ is connected to the reset terminal of the flip-flop $F/F_{16}$.

$F/F_{16}$ is an RS flip-flop in which when a "1" level signal is impressed on the set terminal $S_{16}$, and a "0" level signal on the reset terminal $R_{16}$, the output $Q_{16}$ is obtained at the "1" level; when a "0" level signal is impressed on $S_{16}$ and a "1" level on $R_{16}$, output $Q_{16}$ is obtained at a "0" level; and when a "0" level signal is impressed on both $S_{16}$ and $R_{16}$, the output remains in its former state. The clock signal $T_2$ to $SR_{15}$ is provided by the output from the CR oscillator circuit composed of the inverters $I_{15}$, $I_{16}$ and $I_{17}$ and condenser $C_3$ and variable resistor $R_4$, that is, the output from the inverter $I_{17}$. Its period is $T = (1/C_3R_4)$.

The output $Q_{15}$ from $SR_{15}$ is supplied to the set terminal $S_{16}$. The output $Q_{16}$ from $F/F_{16}$ and the output from the inverter $I_{17}$ are fed into the NAND circuit $NA_2$ as the input thereof; the output therefrom is fed into the inverter $I_{18}$ as the input thereto, and the output therefrom, which is the output of the series of pulses producing circuit, is fed into $F/F_{11}$ as its input thereto and into $F/F_6$ shown in FIG. 8 as the reset input thereto. Moreover, the output (the output from $I_{18}$) is fed into a differential circuit composed of $C_4$ and $R_5$ as the input thereto, and the output B of this differential circuit is led to the gate of the n-channel MOS transistor $Tr_1$. While the source of $Tr_1$ is connected to the $V_{SS}$ terminal, and its drain C to $V_{SS}$ through the resistance $R_6$, one terminal of an condenser $C_5$ having the other terminal linked to $V_{SS}$ is joined to the input terminal of an transfer gate composed of a p-channel transistor $Tr_2$ and an n-channel transistor $Tr_3$ with their sources and drains mutually associated, and the output D of the transfer gate is linked to $V_{DD}$ through a variable resistor $R_7$. The output from the CR oscillator circuit composed of the inverters $I_{20}$, $I_{21}$ and $I_{22}$ and the condenser $C_6$ and variable resistor $R_8$, i.e. the output from $I_{22}$, is fed into the gate of $Tr_3$ and the inverter $I_{19}$ as the inputs thereto, and the output from $I_{19}$ is led to the gate of $Tr_2$.

The movable terminal of the resistor $R_7$ is connected to the base of a PNP transistor $Tr_4$, and the collector of $Tr_4$ to the base of a NPN transistor $Tr_5$. The emitter of $Tr_5$ is linked to the $V_{SS}$ terminal. One terminal of the speaker 7 is connected to the emitter of $Tr_4$ and the collector of $Tr_5$, while the other terminal is linked to the $V_{DD}$ terminal.

In the following, the operation of the time signal circuit of this invention is described in reference to the waveforms of FIGS. 10, 11R6, 11B, 11C and 11D. First, as the magnetically sensitive switch 22 installed on the face at the position corresponding to 12 o'clock is actuated by the permanent magnet 24 mounted on the long hand 23 to indicate the time at which it is desired to produce a time indicating sound signal the magnetically sensitive switch 22 closes the time detecting circuit 100, and as a result, the signal at one terminal A of the switch 22 undergoes a change from a "0" level to a "1" level for producing noise, as shown by waveform A in FIG. 10. After the long hand passes through the position for 12 o'clock, the signal at the point A again goes from the "1" level back to the "0" level. The signal at the point A which has risen from the "0" to the "1" level is eliminated by making use of the integrating circuit composed of $R_2$ and $C_1$, yielding the wave form $D_1$.

$\overline{Q}_1$ changes from the "1" level to the "0" level at the time when the level of the clock signal $T_1$ falls the first time after the signal $D_1$ has risen. $Q_2$ changes from the "0" level to the "1" level at the time when the level of the clock signal $T_1$ falls the second time after the signal $D_1$ has risen. Accordingly, the input to the NOR circuit $NO_1$ is at the "0" level only for one period of clock signal $T_1$ from the time when the level of the clock signal $T_1$ falls the first time after $D_1$ has risen, thereby setting the output from $NO_1$ at the "1" level for that one period only. The output from $I_4$ is, then, converted to a signal held on the "0" level for one period of the clock level $T_1$ as shown by $D_3$. Since the same clock level $T_1$ is applied to $SR_3$, $SR_4$ and $SR_5$, $Q_5$ is produced for one period only after a delay of 3 periods of clock signal $T_1$ as compared with $D_3$.

Then, the output $\overline{Q}_6$ from $F/F_6$ changes from the "1" level to the "0" level when $Q_5$ falls from the "1" level down to the "0" level. If $F/F_{7,8,9,10}$ have been memorizing the condition of 1 o'clock, that is, if $Q_7$ is on the "1" level, while $Q_8$, $Q_9$ and $Q_{10}$ are on the "0" level, then, when the signal at $D_3$ changes from the "1" level to the "0" level, $Q_7$ changes to the "0" level and $Q_8$ to the "1" level, while $Q_9$ and $Q_{10}$ remain at the "0" level; thus, $F/F_{7,8,9,10}$ change state so as to memorize the condition of 2 o'clock.

It is to be noted that in the counting circuit 12 composed of $F/F_{7\sim10}$, NAND circuit and inverter $I_5$, as soon as the condition of 13 o'clock is produced, that is, $Q_7$, $Q_9$ and $Q_{10}$ change to the "1" level, the output of $I_5$ turns to "1", causing $F/F_7$ to be reset, and as a result, the respective outputs $Q_7$, $Q_8$, $Q_9$ and $Q_{10}$ are changed to the levels of "1", "0", "0" and "0". That is to say, this counting circuit 13 is a binary counter which memorizes the decimal numbers 1–12 as binary coded signals.

$F/F_{11} \sim F/F_{14}$ have also been memorizing the condition of 1 o'clock, that is, the outputs $Q_{11}$, $Q_{12}$, $Q_{13}$ and $Q_{14}$ are being held on "1", "0", "0" and "0" levels, and accordingly, the respective inputs to the Exclusive OR circuits $EX_1$, $EX_2$, $EX_3$ and $EX_4$ are in agreement. For this reason, all the outputs of the Exclusive OR circuits are at "0" levels; the reset $R_{16}$ of $F/F_{16}$ is at the "1" level; the output from $NA_2$ is at the "1" level; and the output of the series of pulses producing circuit 13, i.e., the output from $I_{18}$, is at the "0" level.

$TG_1 \sim TG_4$ are conductive because $\overline{Q}_6$, and thus, N, is at the "1" level. If at this time, the signals $Q_7 \sim Q_{10}$ change from "1", "0", "0" and "0" to "0", "1", "0" and "0", the inputs to $EX_1$ and $EX_2$ change so as to be in disagreement changing their output to the "1" level, and consequently the output from the NOR circuit $NO_2$, and thus the reset input $R_{16}$ to $F/F_{16}$, changes to the "0" level. Then, when the signal $\overline{Q}_6$ changes from the "1" level to the "0" level, the reset inputs to $F/F_{11} \sim F/F_{14}$ change from the "0" level to the "1" level, bringing all the outputs $Q_{11} \sim Q_{14}$ to the "0" level. $Q_{15}$, and thus the set input $S_{16}$ to $F/F_{16}$, changes from the "0" level to the "1" level at the time when the clock signal $T_2$ of $SR_{15}$ changes from the "1" level to the "0" level the first time after the signal $\overline{Q}_6$ changes from the "1" level to the "0" level. At this time, since the reset $R_{16}$ is at the "0" level as described hereabove, the output $Q_{16}$ from $F/F_{16}$ undergoes a change from the "0" level to the "1" level in coordination with the time at which $S_{16}$ turns from the "0" level to the "1" level. Accordingly, the output from the NAND circuit $NA_2$ provides a signal $T_2$ which is in the inverse phase to the clock signal $T_2$, and the inverter $I_{18}$ produces the signal $T_2$ as its output. Since the output from $I_{18}$ is fed to the reset of $F/F_6$, when the output from $I_{18}$ is changed from the "0" level to the "1" level by the first pulse, $\overline{Q}_6$ turns from the "0" level to the "1" level. Then, the reset signal to $F/F_{11} \sim F/F_{14}$ is removed. When the output from $I_{18}$ is changed from the "1" level to the "0" level, the outputs from $F/F_{11} \sim F/F_{14}$ change from "0", "0", "0" and "0" to "1", "0", "0" and "0". Then, when the output from $I_{18}$ again changes from the "0" level to the "1" level, producing a second pulse, $Q_{11} \sim Q_{14}$ change from "1", "0", "0" and "0" to "0", "1", "0" and "0". At this time, because the outputs from $I_7$, $I_9$, $I_{11}$ and $I_{13}$ are at the levels of "0", "1", "0" and "0", the inputs to $EX_1 \sim EX_4$ are all in agreement, their outputs all becoming "0". Then, the output from the NOR circuit $NO_2$, and thus, the reset $R_{16}$ for $F/F_{16}$, changes from the "0" level to the "1" level, and as a consequence, the output $Q_{16}$ therefrom changes from the "1" level to the "0" level. Consequently, the output from the NAND circuit $NA_2$ is obtained at this "1" level, producing an output from the inverter $I_{18}$ at the "0" level.

The foregoing description shows that when the time indicated on the face plate is just 2 o'clock, the magnetically sensitive switch becomes conductive; then, the inverter 18 produces only two clock pulses with a period of $T_2$ as its output. The two clock pulses ($R_6$ in FIG. 11R6) are differentiated to produce the wave form shown in FIG. 11B at the point B, in FIG. 9, causing the N-channel transistor TR, to be ON for a short period of time relative to $T_2$. Then, the wave form at the point C may be altered to be a relaxation signal as shown in FIG. 11C by giving appropriate values to the resistance $R_6$ and condenser $C_5$. The CR oscillator, composed of the inverters $I_{20}$, $I_{21}$ and $I_{22}$ and variable resistor $R_8$ and condenser $C_6$ is so set as to produce a frequency $f_3$ in the audible range. When the output from $I_{22}$ is at the "1" level, the P-channel transistor $Tr_2$ and the N-channel transistor $Tr_3$ turn ON, permitting the wave form at the point C to be delivered to the poing D in FIG. 9 as it is. If the output from $I_{22}$ changes to the "0" level, however, $Tr_2$ and $Tr_3$ turn OFF, and as a result, the potential at the point D is brought to the level of $V_{DD}$ due to the variable resistor $R_7$. Consequently, the wave form at the point D is that of the relaxation signal of FIG. 11C modulated the audible frequency $f_3$, as shown in FIG. 11D, with a time constant determined by the resistance $R_6$ and condenser $C_5$.

When a potential difference of more than 0.6 V is produced between the emitter and the base of $Tr_4$, $Tr_4$ is turned ON, and a current $hfe_4$ times as large as the base current flows in the collector, and thus, in the base of $Tr_5$. Accordingly, in $Tr_5$, the potential difference between the base and the emitter becomes larger than 0.6 V, and a current $hfe_4 x\ hfe_5$ times as large as the base current of $Tr_4$ flows as the collector current. Thereby the speaker produces an electronic sound which has the reverberation effect corresponding to the relaxation signal at an audible frequency of $f_3$. On the other hand, when the potential at the point D is at the $V_{DD}$ level, the potential difference between the emitter and the base of $Tr_4$ is smaller than 0.6 V, and accordingly, $Tr_4$ and thus $Tr_5$ are OFF; with no current flowing in the speaker 16, no electronic sound is produced.

The foregoing description shows that the period of the CR oscillator composed of inverters $I_{15}$, $I_{16}$ and $I_{17}$ and variable resistance $R_4$ and condenser $C_3$ determines the interval between the time indicating sound signals, the interval being alterable by the variable resistance $R_4$.

The frequency of the CR oscillator composed of inverters $I_{20}$, $I_{21}$ and $I_{22}$ and variable resistor $R_8$ and condenser $C_6$ determines the tone of the time indicating sound signal, the tone of the time indicating sound signal being alterable by means of the volume $R_8$. Furthermore, since the variable resistor $R_7$ determines the amplitude of the signal at the point D, the strength of the time indicating sound signal may be altered by changing the volume $R_7$.

The above-described time indicating sound signal circuit is so composed that the same number of electronic sounds as the numeral representing the time (e.g., two electronic sounds are produced at the time of 2 o'clock) can be produced even if only one signal enters the circuit at the predetermined time. Such a circuit obviously will find use not only in analogue type electronic clocks, but in conventional electrical clocks, alarm clocks, spring driven clocks or leaf type digital clocks as well.

When making the time indicating signal circuit of this invention as an integrated circuit, a $F/F_{17}$ can be used in place of the differential circuit composed of condenser $C_4$ and resistance $R_5$, as shown in FIG. 12; the output of the inverter $I_{18}$ is applied as the input $\phi_{17}$, and the clock signal $T_1$ of $SR_1$ is applied to the reset input $R_{17}$, and the output $Q_{17}$ therefrom is fed into the gate of the N-channel transistor $Tr_1$. Moreover, in the place of the resistance $R_6$, a P-channel transistor $Tr_6$ can be used, with its source connected to $V_{DD}$ and its gate and drain to the drain terminal C of $Tr_1$. Furthermore, the resistances $R_1$ and $R_3$ can be replaced by similar load MOS transistors such as $Tr_6$. In that way, the resistance $R_2$, which in practice is on the order of several tens of KΩ, can be integrated as the P well resistance, and the condenser $C_1$, which is on the order of several PF, is amenable to integration.

In the electronic clock described hereabove, the signal detected by the time detecting circuit 10 which detects the predetermined time by the movement of the clock hands is cleared of noise; the signal which has had its wave form shaped by the switching circuit 11 is counted by the counting circuit 12; the input signal to the counting circuit is delayed; a number of pulses which are to be produced is controlled by comparing, in the comparison circuit 15, the output from the counting circuit 12 with the information memorized by the series of pulses producing circuit 13; the timing for the start of the pulses constituting the time indicating signal is set by the output of the delay circuit 14; the number of pulses to be transmitted from the start to the end of the time signal is memorized, and the number of pulses corresponding to time indicating signals equal to the numeral representing the time indicated by the short hand on the clock are produced as the output from the series of pulses producing circuit. Then, the time indicating signals produced as the output from the series of pulses producing circuit are converted into relaxation signals through the modulation circuit 16, and these signals are amplified, to produce the time indicating sound signal from the speaker 70.

Thus, the output from the time detecting circuit 10 is fed into the switching circuit 11 as its input; the output of the aforementioned switching circuit 11 is delivered to the counting circuit 12 and the delay circuit 14 as inputs thereto; the output from the counting circuit is supplied as one input to the comparison circuit 15, the outputs from the delay circuit 14 and the comparison circuit 15 are supplied as the inputs to the pulse producing circuit 13; the output from the pulse producing circuit 13 is supplied to the comparison circuit as a second input thereto and to the modulation circuit 16 as the input thereto; the output from the modulation circuit 16 is supplied to the amplifier circuit 17 as the input thereto, and finally, the output from the amplifier circuit is supplied to the input side of the speaker 70.

It is to be noted that SR's may be substituted for the F/F's shown in FIGS. 8 and 9.

FIG. 13 shows another embodiment of the present invention. Generally, a person becomes more sensitive to sound at night and there is a possibility the sound will be heard as a harsh noise. For this reason, the time indicating signal producing device of FIG. 13 is so constructed that a speaker is used as a time indicating signal producing means in the day time and a light producing means is used in place of the speaker in the night time.

In FIG. 13, the same numerals are used for to the same elements as in FIG. 9 so that the explanation of the functions of these elements is omitted.

Referring to FIG. 13, fixed terminals $x_1$ and $y_1$ of a switch $SW_1$ are connected to the variable terminal of the variable resistance $R_7$ and the output terminal of $NA_2$, respectively. The movable terminal $Z_1$ of the switch $SW_1$ is connected to the base electrode of $Tr_4$. Fixed terminals $x_2$ and $y_2$ of a switch $SW_2$ are connected to one terminal of the speaker 70 and one terminal of a lamp 71, the other terminals of which are connected to $V_{DD}$, respectively. The movable terminal $Z_2$ of the switch $SW_2$ is connected to the collector electrode of $Tr_5$. A light detector $x$ which is a main element of Cds, Se, or the like which has a characteristic that its internal resistance decreases when it is irradiated with light and an electromagnetic relay Ry which operates the switches $SW_1$ and $SW_2$ are connected in series between $V_{DD}$ and $V_{SS}$ terminals. In FIG. 9, the emitter electrode of $Tr_4$ is connected to the collector electrode of $Tr_5$, but in FIG. 13, the emitter electrode of $Tr_4$ is connected to the $V_{DD}$ terminal.

In FIG. 13, when the light detector $x$ receives light for example during the day time, current flows through the electromagnetic relay RY and the movable terminals $Z_1$ and $Z_2$ of $SW_1$ and $SW_2$ are connected to the terminals $x_1$ and $x_2$, respectively. Thus, when pulses are transmitted from the output terminal of $NA_2$, the speaker produces an electronic sound. On the other hand, the light detector $x$ does not receive light during the night time, so that movable $Z_1$ and $Z_2$ of $SW_1$ and $SW_2$ are connected to terminals $y_1$ and $y_2$ because the electromagnetic relay is not operated. Thus, when pulses are transmitted from the output terminal of $NA_2$, the pulses are amplified by $hfe_4 x\ hfe_5$ by $Tr_4$ and $Tr_5$ and the lamp 71 turns on and off in accordance with the number of pulses.

Furthermore, shown in FIG. 14, as for a sound producing means, a bell may be used instead of the speaker. In FIG. 14, numeral 41 designates an electromagnet; 43 a hammer; 44, a spring, one end of which is connected to the hammer 43; and 46, a sound producing member which produces sound when struck by the hammer 43.

When time signal 45 is supplied to electromagnet 41, the hammer 43 strikes the sound producing member 47 when attached by the electromagnetic 41.

The shape and kind of the sound producing member 41 may be selected freely and a plurality of sound producing members which respectively have different frequencies may be also employed.

Further, in FIG. 14, although the sound producing member produces sound when the electromagnet attracts the hammer, the arrangement could be reversed so that when the hammer is released from the attractive force of the electromagnet, it strikes the sound producing member. The Effects of This Invention:

(1) As described hereinabove, the time signal clock of this invention is a clock capable of giving an accurate time indication by hands driven by electronic circuits, and in which a time indicating signal is produced at predetermined times without fail by means of a set of detecting means installed at a position corresponding to the time at which the time indicating signal is desired.

(2) Hitherto, with electronic clocks, only the visual sense has been usable as the means for perceiving time. By the present invention, the auditory sense has now been made usable for perceiving time, so that a person need not bother to observe his clock when he wants to have definite perception of time. The clock of the present invention can also be modified to give a visual indication of the exact time even in dark places, as at night.

(3) When applied to quartz clocks, the time signal functions may be provided easily without disturbing the visual image.

(4) The time signal circuit contains rather a small number of elements, and is amenable to being formed as an integrated circuit except for variable resistors $R_4$, $R_7$ and $R_8$, condensers $C_2$, $C_3$, $C_5$ and $C_6$ and transistors $Tr_4$ and $Tr_5$. Accordingly, a clock capable of giving a time indicating signal can be made at a low cost merely by adding, as the time indicating signal mechanism, the detecting device including the magnetically sensitive switch, permanent magnet, etc., and the speaker, etc.

(5) Because the circuit is so composed that the time indicating sounds signal is produced with a frequency which is most comfortable to the human ears, and with a sustain or reverberation effect, easy auditory perception of time is possible even in a noisy environment.

What we claim is:

1. An electronic time indicating signal clock comprising a time indicating means, a frequency dividing circuit for dividing a standard oscillation frequency, electronic driving means to which said frequency dividing circuit is coupled and which is driven by the output of said frequency dividing circuit, said driving means being coupled to said time indicating means for driving said time indicating means, time detecting means coupled to said time indicating means for detecting when said time indicating means indicates one of a plurality of particular periodic times occuring at regular intervals from each other for which it is desired to produce a unique time indicating signal and producing a time detecting output signal each time one of the plurality of particular periodic times is detected as being indicated, a time indicating signal producing circuit coupled to said time detecting means for producing in response to receipt of said time detecting output signal a unique time indicating signal corresponding to each of the plurality of particular periodic times indicated by said time indicating means, and a time indicating signal producing means coupled to said time indicating signal producing circuit for producing a time indication signal which is perceivable by at least one of the human senses in response to the time indicating signal.

2. An electronic time indicating signal clock as claimed in claim 1 in which said time indicating means is means for indicating time visually and said time indicating signal producing means is an audio signal producing means.

3. An electronic time indicating signal clock as claimed in claim 2 in which said audio signal producing means is an audio speaker.

4. An electronic time indicating signal clock as claimed in claim 3 in which said time indicating signal producing circuit includes means for producing a plurality of pulses corresponding to the particular periodic time to be indicated and means for modulating said pulses for providing a reverberation effect.

5. An electronic time indicating signal clock as claimed in claim 2 in which said audio signal producing means is a bell and said time indicating signal producing circuit produces a series of pulses corresponding to the number of the hour indicated by said time indicating means for causing said bell to be sounded a number of times corresponding to the number of pulses.

6. An electronic time indicating signal clock as claimed in claim 2 in which said time indicating signal producing circuit includes means for producing a plurality of pulses corresponding to the particular periodic time to be indicated and means for modulating said pulses for varying the interval between said pulses and the tone produced by said audio signal producing means actuated by said pulses.

7. An electronic time indicating signal clock as claimed in claim 1 in which said time indicating means is a clock face and minute and hour hands movable around said clock face, and said time detecting means is a detector for detecting when the minute hand passes a particular point on said clock face corresponding to the particular periodic time to be indicated.

8. An electronic time indicating signal clock as claimed in claim 1 in which said time indicating means is means for indicating time visually and said time indicating signal producing means comprises audio signal producing means for producing an audio signal and light signal producing means for producing a light signal.

9. An electronic time indicating signal clock as claimed in claim 8 in which said time indicating signal producing means further includes switching means coupled to said audio signal producing means and said light signal producing means for causing one or the other of said signal producing means to operate in response to the time indicating signal.

10. An electronic time indicating signal clock as claimed in claim 9 in which said switching means includes light detecting means for switching said switching means to cause said audio signal producing means to be operative when the presence of light is detected by said light detecting means.

11. An electronic time indicating signal clock as claimed in claim 1 in which said time indicating signal producing circuit comprises a counting circuit for counting the signals from said time detecting circuit, a pulse series producing circuit for producing a series of pulses until reset and memorizing the number of pulses produced, and a comparison circuit coupled to said counting circuit and to said pulse series producing circuit for comparing the output of said counting circuit with the number of pulses memorized in the pulse series producing circuit and for resetting said pulse series producing circuit when the number memorized in said pulse series producing circuit equals the output of said counting circuit.

* * * * *